US012214240B1

(12) United States Patent
Wu

(10) Patent No.: US 12,214,240 B1
(45) Date of Patent: Feb. 4, 2025

(54) BARBELL

(71) Applicant: Wuyi Boda industry and trade Co., LTD., Jinhua (CN)

(72) Inventor: Zige Wu, Jinhua (CN)

(73) Assignee: Wuyi Boda industry and trade Co., LTD., Jinhua (CN)

( * ) Notice: Subject to any disclaimer, the term of this patent is extended or adjusted under 35 U.S.C. 154(b) by 0 days.

(21) Appl. No.: 18/925,034

(22) Filed: Oct. 24, 2024

(30) Foreign Application Priority Data

May 14, 2024 (CN) ..... 202410593335.2

(51) Int. Cl.
*A63B 21/072* (2006.01)
*A63B 21/075* (2006.01)

(52) U.S. Cl.
CPC ..... *A63B 21/0728* (2013.01); *A63B 21/0724* (2013.01); *A63B 21/075* (2013.01)

(58) Field of Classification Search
CPC ..... A63B 21/0724; A63B 21/0728; A63B 21/075
See application file for complete search history.

(56) References Cited

U.S. PATENT DOCUMENTS 4,453,710 A * 6/1984 Plotz ..... A63B 21/0728 403/167
5,911,651 A * 6/1999 Liu ..... A63B 21/0728 482/107
6,776,741 B2 * 8/2004 Burwell ..... A63B 21/0728 482/106
7,037,245 B2 * 5/2006 Burwell ..... A63B 21/075 482/106
7,588,520 B2 * 9/2009 Nalley ..... A63B 21/075 482/99
8,790,223 B2 * 7/2014 Wang ..... A63B 21/075 482/106
11,052,276 B1 * 7/2021 Baker ..... A63B 21/0604
11,712,595 B2 * 8/2023 Young ..... A63B 21/0724 482/107
11,794,061 B2 * 10/2023 Yao ..... A63B 21/0728
12,102,866 B2 * 10/2024 Wang ..... A63B 21/0722
12,138,503 B2 * 11/2024 Chen ..... A63B 21/072
2022/0401789 A1 * 12/2022 Li ..... A63B 21/0724
2023/0173326 A1 * 6/2023 Yao ..... A63B 21/0728 482/107
2023/0173327 A1 * 6/2023 Wang ..... A63B 21/075 482/107
2023/0285794 A1 * 9/2023 Zhou ..... A63B 21/0724
2024/0181288 A1 * 6/2024 Chen ..... A63B 21/0728
2024/0285996 A1 * 8/2024 Choudhury ..... A63B 21/075

* cited by examiner

*Primary Examiner* — Joshua Lee
(74) *Attorney, Agent, or Firm* — Ying-Ting Chen

(57) ABSTRACT

Disclosed is a barbell including a lever assembly; a pair of snapping assemblies disposed at two ends of the lever assembly and fixedly connected to the lever assembly, where each of the snapping assemblies comprises a first snapping member and a first limiting member, one end of the first snapping member is provided with a first snapping portion, the other end of the first snapping member is provided with a second snapping portion, the first snapping portion is provided with a first snapping recess, and the first snapping member is fixedly connected to the first limiting member and is fixedly connected to the lever assembly through the second snapping portion, and a plurality of weight plates snapped with each other and snapped with the first snapping portion.

20 Claims, 9 Drawing Sheets

BARBELL

CROSS-REFERENCE TO RELATED APPLICATIONS

This application claims priority to Chinese Patent Application No. 202410593335.2, filed on May 14, 2024, the content of which is incorporated herein by reference in its entirety.

TECHNICAL FIELD

The disclosure relates to the technical field of fitness devices, and more particularly to a barbell.

BACKGROUND

There are two main kinds of barbells in the related art: a barbell with fixed weight and a barbell with adjustable weight. When the former barbell with fixed weight is used, a set of barbells with different weights must be prepared to meet the needs of trainers. The latter is deeply welcomed by athletic trainers because the weight can be adjusted.

In the related art, most of the weight-adjustable barbells are complex in structure, cannot quickly increase or reduce weight or cannot independently adjust the weight of two ends, or are very expensive. In addition, the lever assembly of the barbell is large in size and difficult to fit into a corresponding toolbox. Therefore, there is an urgent need for a barbell that can be quickly adjusted and has a low cost to meet the needs of the majority of sports fans.

SUMMARY

According to an embodiment of the present disclosure, a barbell is provided and comprises:

a lever assembly;

a pair of snapping assemblies, disposed at two ends of the lever assembly and fixedly connected to the lever assembly;

where each of the snapping assemblies comprises a first snapping member and a first limiting member, one end of the first snapping member is provided with a first snapping portion, the other end is provided with a second snapping portion, the first snapping portion is provided with a first snapping recess, and the first snapping member is fixedly connected to the first limiting member and is fixedly connected to the lever assembly through the second snapping portion; and a plurality of weight plates, snapped with each other and snapped with the first snapping portion.

Optionally, the weight plate comprises:

a front fixing member, provided with a third snapping portion and a first channel, where the first channel penetrates the third snapping portion and the third snapping portion is provided with a second snapping recess;

a rear fixing member, fixedly connected to the front fixing member and provided with a second channel;

a snapping module, movably disposed between the front fixing member and the rear fixing member, where the third snapping portion of the adjacent weight plate is capable of being inserted into the second channel to be snapped with the snapping module;

a pressing module, movably connected to the front fixing member through the first channel, to drive the snapping module to open and close; and a first limiting sleeve, sleeved on the pressing module and fixedly connected to the front fixing member, for limiting a maximum stroke of the pressing module, where a pair of first sliding slots and a pair of second sliding slots are disposed on two opposite sides of the first limiting sleeve.

Optionally, the snapping module comprises:

a pair of second snapping members, where an upper end of each of the second snapping members is provided with a first driving portion and a lower end of each of the second snapping members is provided with a fourth snapping portion, the first driving portion is connected to the pressing module, the fourth snapping portion is connected to the second snapping recess of the adjacent weight plate; and a pair of first elastic members, where the pair of first elastic members are one-to-one corresponding to the pair of second snapping members, and are disposed between the corresponding second snapping members and the front fixing member or the rear fixing member, for resetting the corresponding second snapping member.

Optionally, the second snapping member is provided with a first limiting slot and one end of the corresponding first elastic member is provided in the first limiting slot.

Optionally, the second snapping member is provided with a first limiting protrusion and a pair of second limiting slots;

where the first limiting protrusion is disposed on a lower side of the second snapping member and the pair of second limiting slots are disposed at two ends of the first limiting protrusion.

Optionally, the pressing module comprises:

a button capable of being reciprocated and sliding inside the first channel;

at least one pressing member, where one end of the pressing member is fixedly connected to the button, the other end of the pressing member is tapered and connected to the snapping module;

a pair of third snapping members, where the pair of third snapping members are respectively disposed on two sides of the pressing member, one end of each of the third snapping members is fixedly connected to the button, and the other end of each of the third snapping members is snapped with the front fixing member to prevent the pressing member from detached from the first channel; and a second elastic member, where one end of the second elastic member is connected to the button, and the other end of the second elastic member is connected to the front fixing member, for resetting the button.

Optionally, the second elastic member is a spring, the first channel is provided with a first annular protrusion, the second elastic member is disposed between the first annular protrusion and the button, the first annular protrusion is further provided with a second annular protrusion, and one end of the second elastic member close to the first annular protrusion is sleeved on the second annular protrusion.

Optionally, the front fixing member is further provided with at least one second limiting protrusion and the rear fixing member is provided with a third limiting slot coupled with the second limiting protrusion.

Optionally, the barbell further comprises a weight assembly connected to the front fixing member and/or the rear fixing member and a weight of the weight assembly is adjustable.

Optionally, the barbell further comprises a protective cover sleeved on the weight assembly.

Optionally, the front fixing member and/or the rear fixing member are provided with a fourth limiting slot and the snapping module is provided inside the fourth limiting slot.

Optionally, the lever assembly comprises:

a first rod body, where one end of the first rod body is fixedly connected to the second snapping portion of the corresponding first snapping member;

an elastic pin, disposed at the other end of the first rod body and protruded from the first rod body; and a second rod body, where one end of the second rod body is sleeved at the other end of the first rod body and fixed by an elastic pin, and the other end of the second rod body is fixedly connected to the second snapping portion of the corresponding first snapping member.

Optionally, the second snapping portion is provided with a third snapping recess, and the first limiting member is provided in the third snapping recess, two sides of the third snapping recess are respectively provided with a first positioning hole, and a bottom of the third snapping recess is provided with a second positioning hole.

The barbell according to the embodiment of the disclosure has the advantages of simple structure, low cost, and easy storage. A plurality of weight plates can be snapped to each other, which has strong adaptability and replaceability. The weight for the bodybuilder can be adjusted by adjusting the number of the snapped weight plates. At the same time, the weight of one single weight plate can be controlled by adjusting the quality of the weight assembly.

It is to be understood that the foregoing general description and the following detailed description are exemplary and are intended to provide further illustration of the claimed technology.

DETAILED DESCRIPTION OF THE EMBODIMENTS

Figure 1:
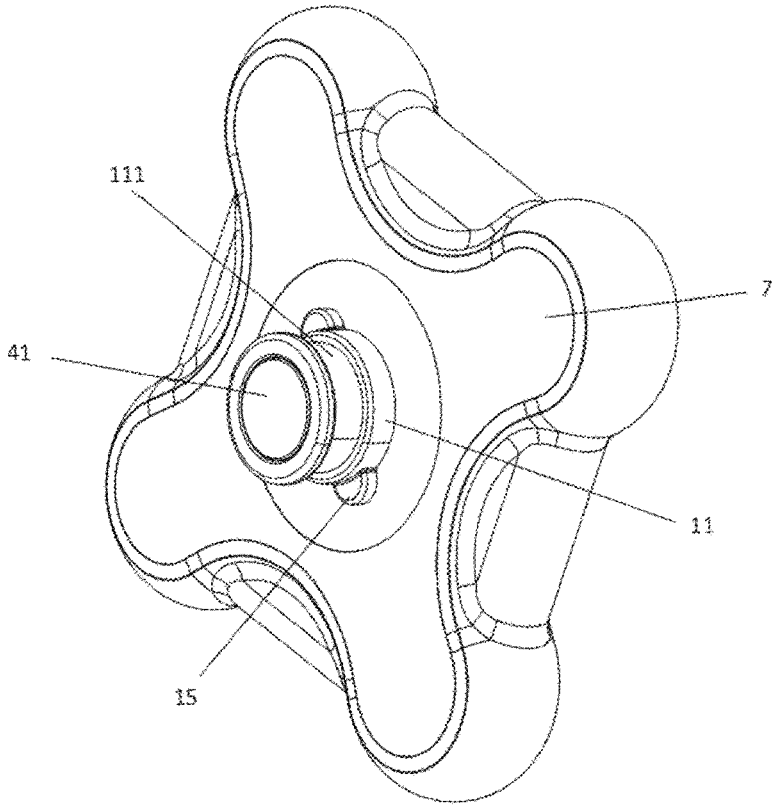
FIG. 1 is a schematic perspective view of a weight plate according to an embodiment of the present disclosure.
Figure 2:
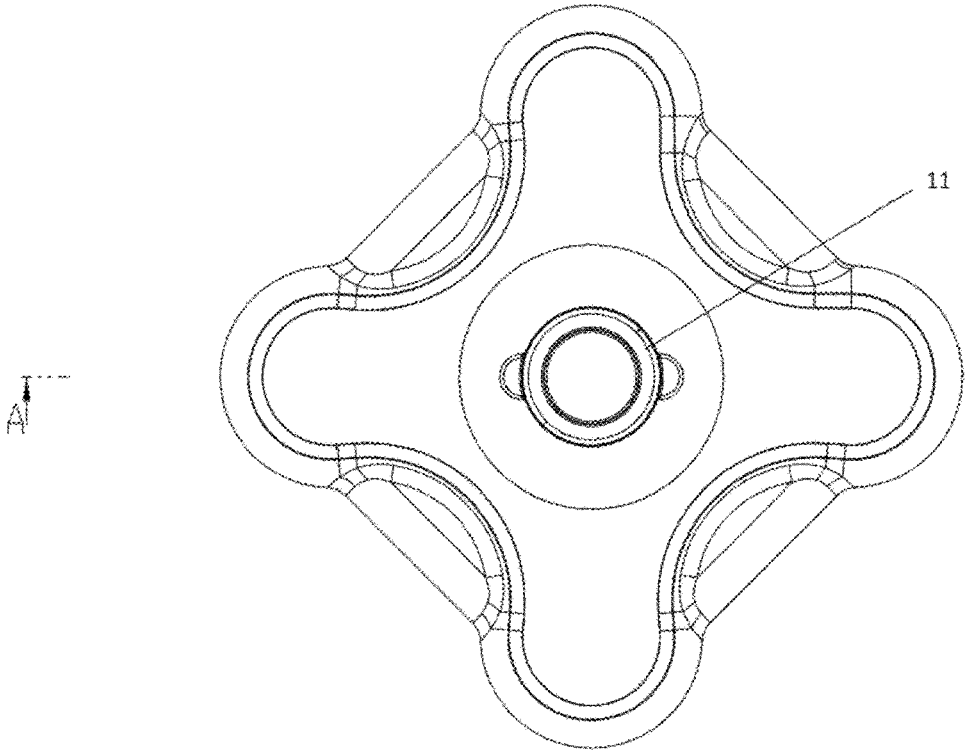
FIG. 2 is a front view of the weight plate according to the embodiment of the present disclosure.

Hereinafter, the embodiment of the present disclosure will be described in detail with reference to the accompanying drawings, and the present disclosure will be further illustrated.

First, a barbell according to an embodiment of the present disclosure will be described with reference to FIGS. 1 to 17, which is used in the fitness field with wide application scenarios.

As shown in FIGS. 1 to 17, the barbell according to the embodiment of the present disclosure comprises:

a lever assembly 8;

a pair of snapping assemblies 9, where the pair of snapping assemblies 9 are disposed at two ends of the lever assembly 8 and are fixedly connected to the lever assembly 8;

where the snapping assembly 9 comprises a first snapping member 91 and a first limiting member 92, one end of the first snapping member 91 is provided with a first snapping portion 911, the other end is provided with a second snapping portion 912, a first snapping groove 9111 is provided on the first snapping portion 911, the first snapping portion 91 is fixedly connected to the first limiting member 92 and is fixedly connected to the lever assembly 8 through the second snapping portion 912; and a plurality of weight plates, where the plurality of weight plates can be snapped with each other and snapped with the first snapping portion 911, the first limiting member 92 is used to limit the position of the weight plate and prevent relative rotation between the weight plate and the first snapping portion 911.

Optionally, in the embodiment, the lever assembly 8 has a hollow structure, which can reduce the manufacturing cost.

Optionally, as shown in FIGS. 1 to 10, in the present embodiment, the weight plate comprises:

a front fixing member 1, provided with a third snapping portion 11 and a first channel 12, where the first channel 12 penetrates the third snapping portion 11 and the third snapping portion 11 is provided with a second snapping recess 111;

a rear fixing member 2, fixedly connected to the front fixing member 1, where the rear fixing member 2 is provided with a second channel 21;

where the front fixing member 1 and the rear fixing member 2 can be fixedly connected by screws;

a snapping module 3, movably disposed between the front fixing member 1 and the rear fixing member 2, where the third snapping portion 11 of the adjacent weight plate can be inserted into the second channel 21 to snap with the snapping module 3;

a pressing module 4, movably connected to the front fixing member 1 through the first channel 12, to drive the snapping module 3 to open and close; and a first limiting sleeve 5, sleeved on the pressing module 4 and is fixedly connected to the front fixing member 1, for limiting the maximum stroke of the pressing module 4, where a pair of first sliding slots 51 and a pair of second sliding slots 52 are provided on two opposite sides of the first limiting sleeve 5.

Optionally, as shown in FIGS. 3 to 4, 6, and 8 to 9, in the present embodiment, the snapping module 3 comprises:

a pair of second engaging members 31, provided with a first driving portion 311 at an upper end of the second engaging member 31 and a fourth snapping portion 312 at a lower end of the second engaging member 31, where the first driving portion 311 is connected to the pressing module 4 and the fourth snapping portion 312 can be connected to the second snapping recess 111 of the adjacent weight plate; and a pair of first elastic members 32, where the pair of first elastic members 32 and the pair of second snapping members 31 correspond one-to-one, the pair of first elastic members 32 are provided between the corresponding second snapping members 31 and the front fixing member 1 or the rear fixing member 2, for resetting the corresponding second snapping members 31, and the first elastic members 32 are springs optionally.

Figure 3:
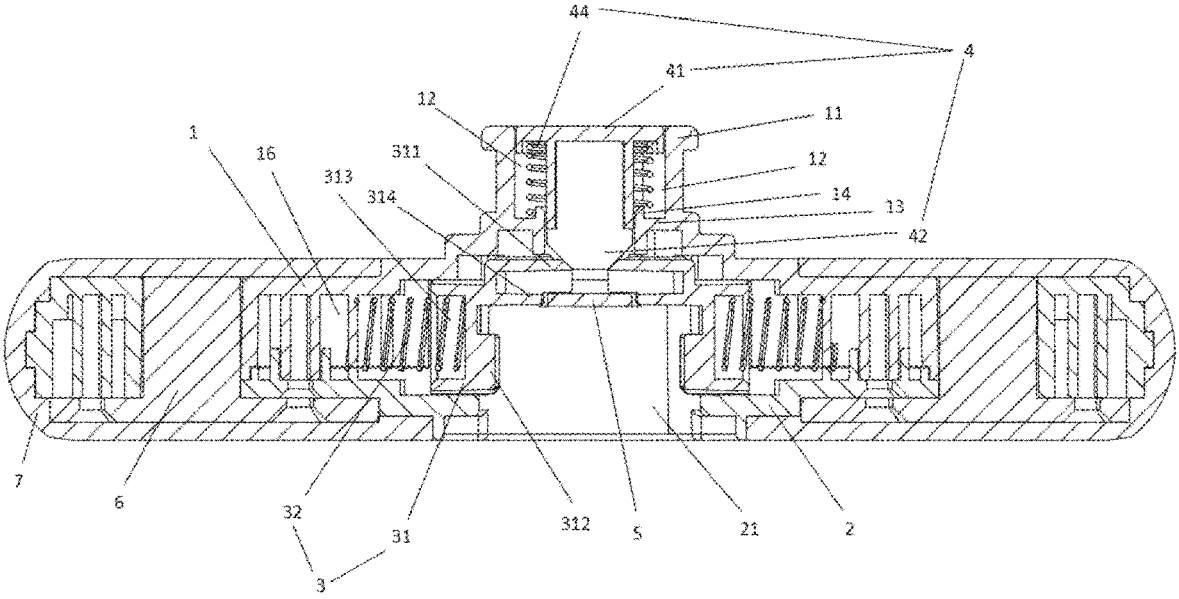
FIG. 3 is a cross-sectional view taken along line A-A of FIG. 2.
Figure 4:
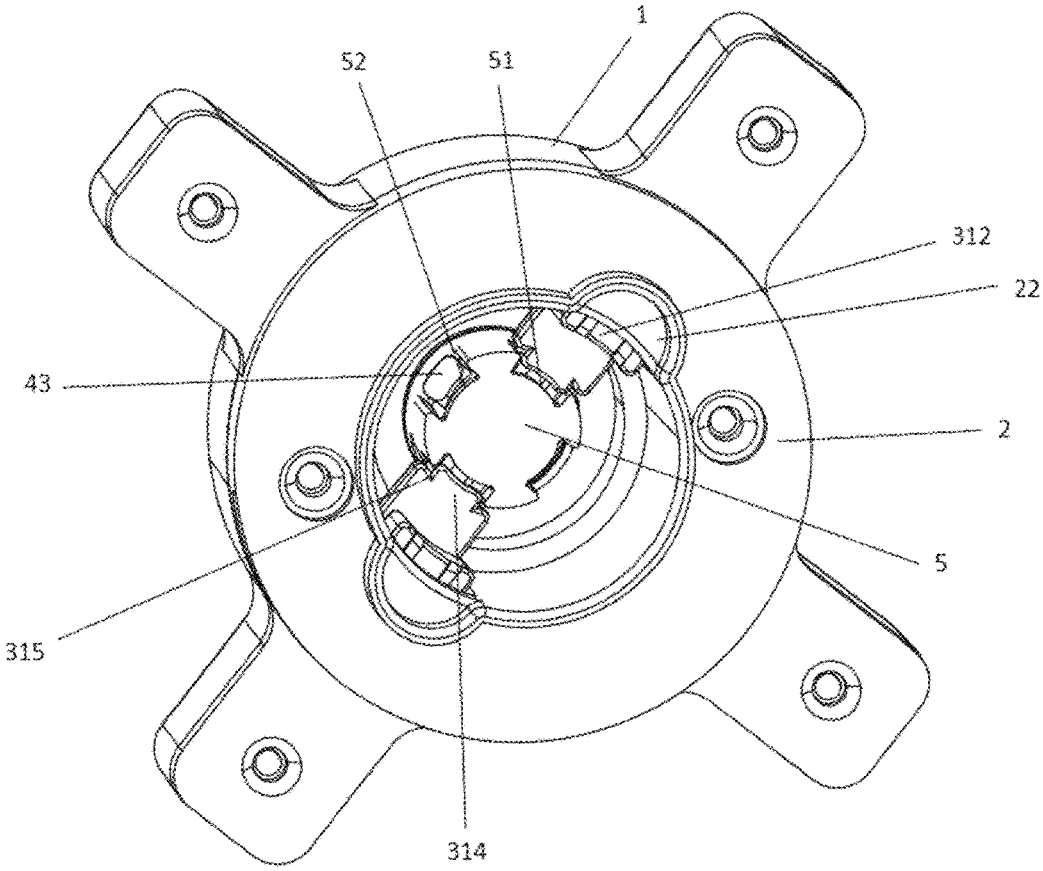
FIG. 4 is a schematic perspective view of the weight plate according to the embodiment of the present disclosure after the protective cover and the weight assembly are removed.
Figure 5:
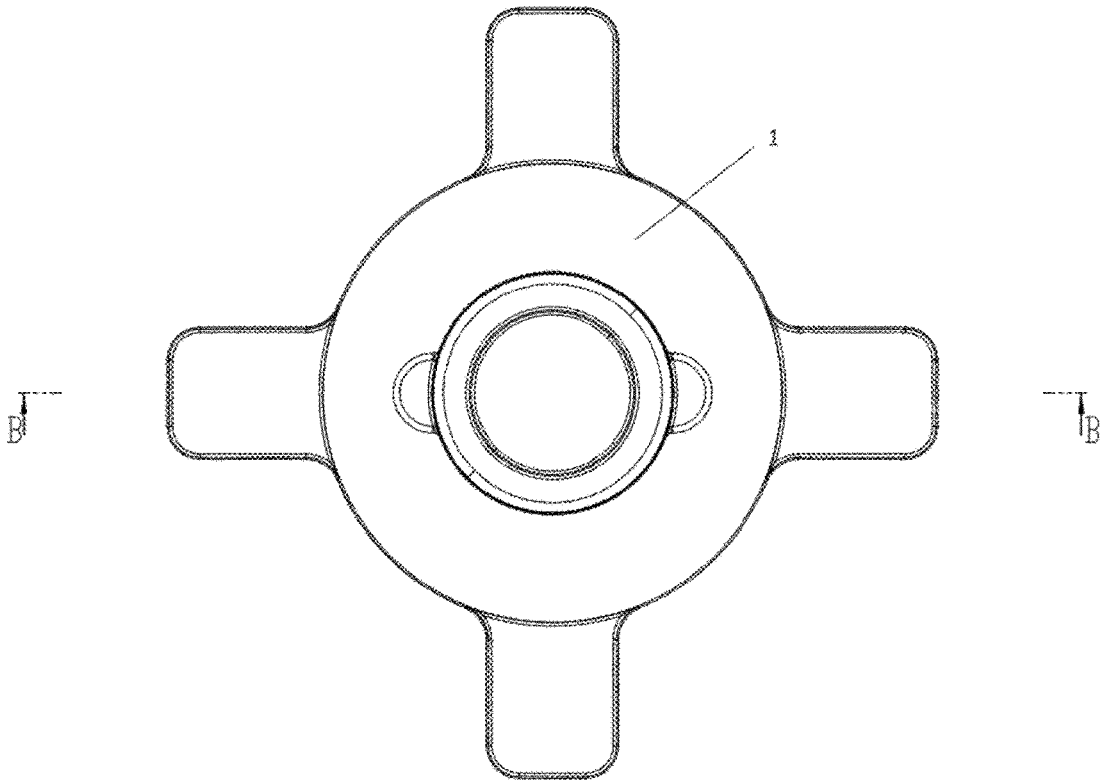
FIG. 5 is a rear view of FIG. 4.

Optionally, as shown in FIG. 3, in the embodiment, a first limiting slot 313 is provided on the second snapping member 31, and one end of the corresponding first elastic member 32 is provided inside the first limiting slot 313, to prevent the first elastic member 32 from being detached from the second snapping member 31.

Optionally, as shown in FIGS. 3 to 4, 6, and 8, in the embodiment, the first limiting protrusion 314 and a pair of second limiting slots 315 are provided on the second snapping member 31.

The first limiting protrusion 314 is provided on the lower side of the second snapping member 31 and the pair of second limiting slots 315 are provided at two ends of the first limiting protrusion 314, when the first limiting protrusion 314 is inserted into the first sliding slot 51, so as to further limit the position and prevent the second snapping member 31 from rotating.

Optionally, as shown in FIGS. 3 to 4, 6, and 8, in the present embodiment, the pressing module 4 comprises:

a button 41, capable of being reciprocating and sliding within the first channel 12;

at least one pressing member 42, where one end of the pressing member 42 is fixedly connected to the button 41 and the other end is tapered and connected to the snapping module 3;

a pair of third snapping members 43, where the pair of third snapping members 43 are respectively disposed on two sides of the pressing member 42, one end is fixedly connected to the button 41 and can be snapped with the front fixing member 1, and the other end is disposed in the second sliding slot 52 and can slide in the second sliding slot 52, to prevent the pressing member 42 from being detached from the first channel 12; and a second elastic member 44, where one end of the second elastic member 44 is fixedly connected to the button 41 and the other end of the second elastic member 44 is connected to the front fixing member 1, for resetting the button 41.

Figure 6:
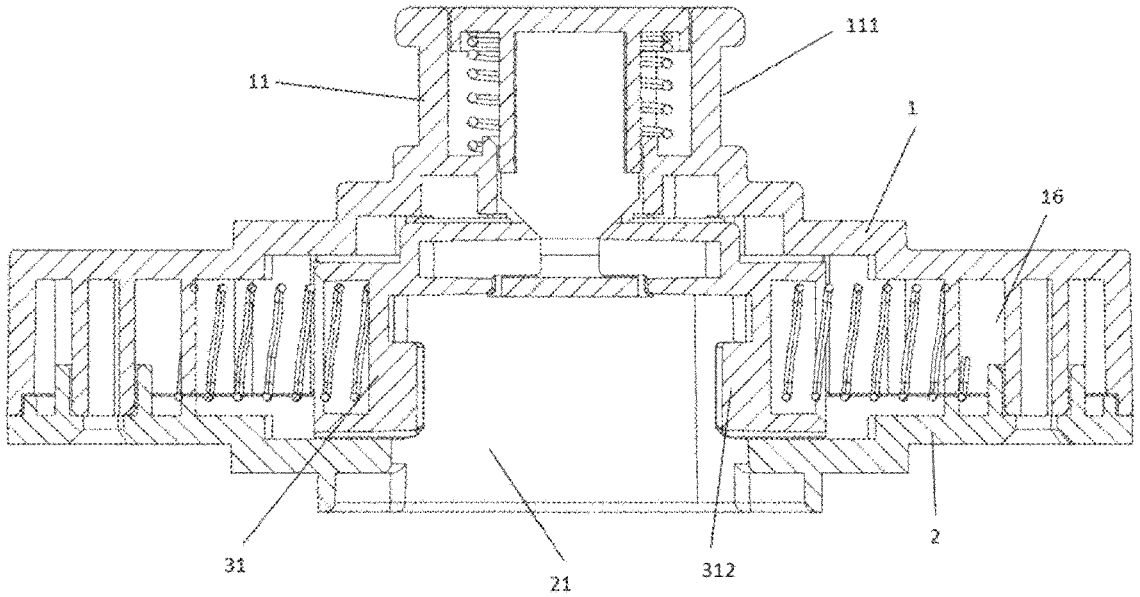
FIG. 6 is a cross-sectional view taken along line B-B of FIG. 5.
Figure 7:
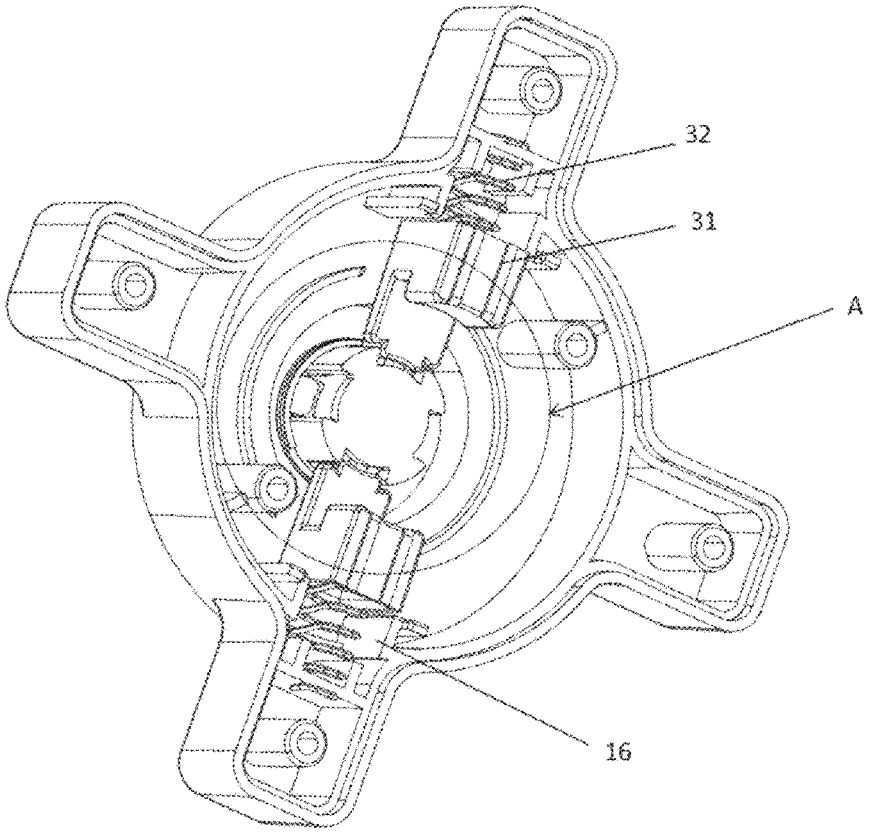
FIG. 7 is a schematic diagram of the internal structure of FIG. 4.
Figure 8:
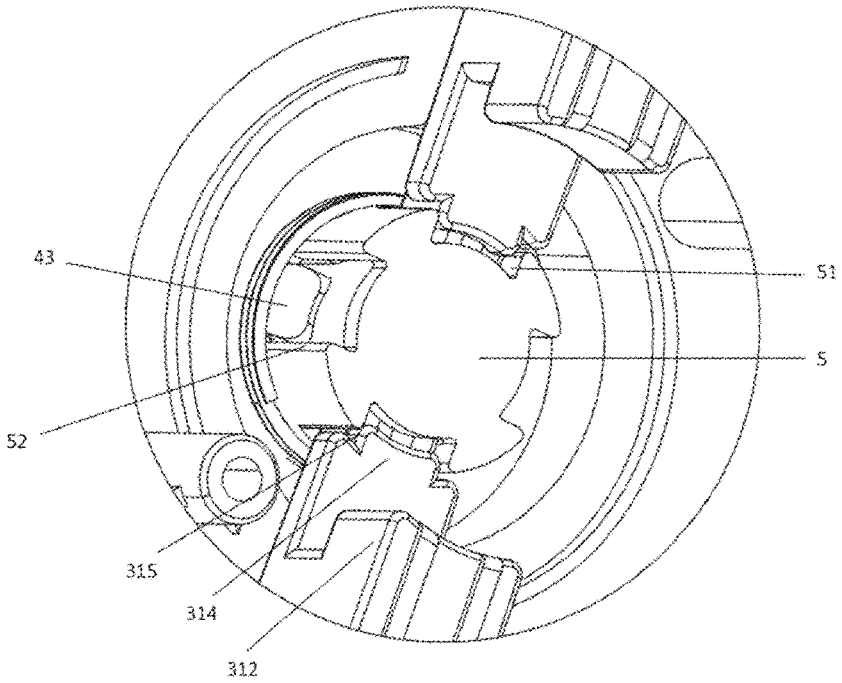
FIG. 8 is an enlarged view at A of FIG. 7.
Figure 9:
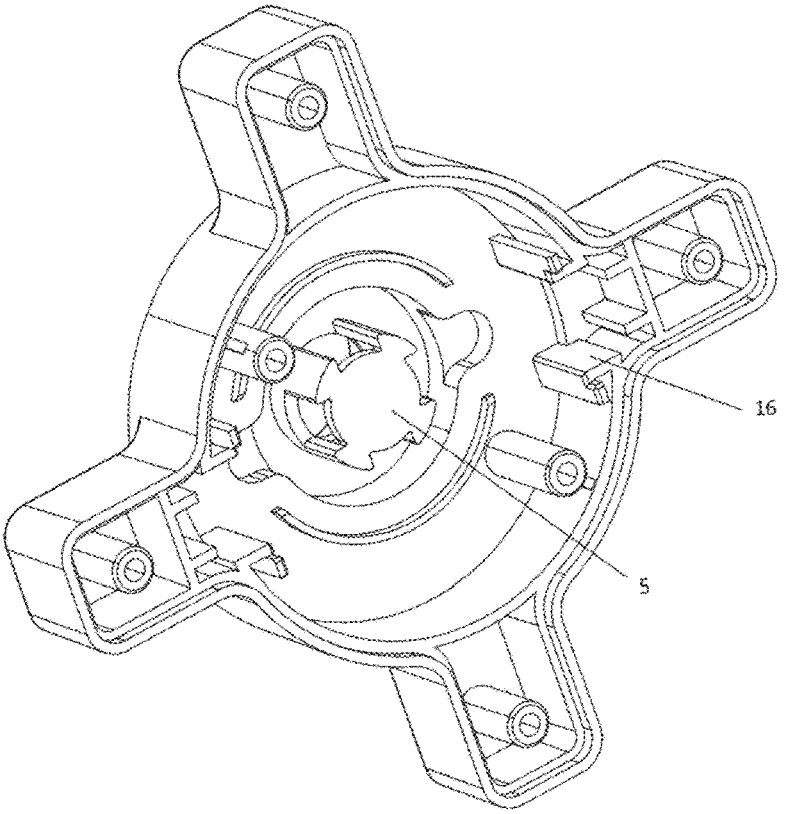
FIG. 9 is an internal schematic view of the front fixing member of the weight plate according to the embodiment of the present disclosure.
Figure 10:
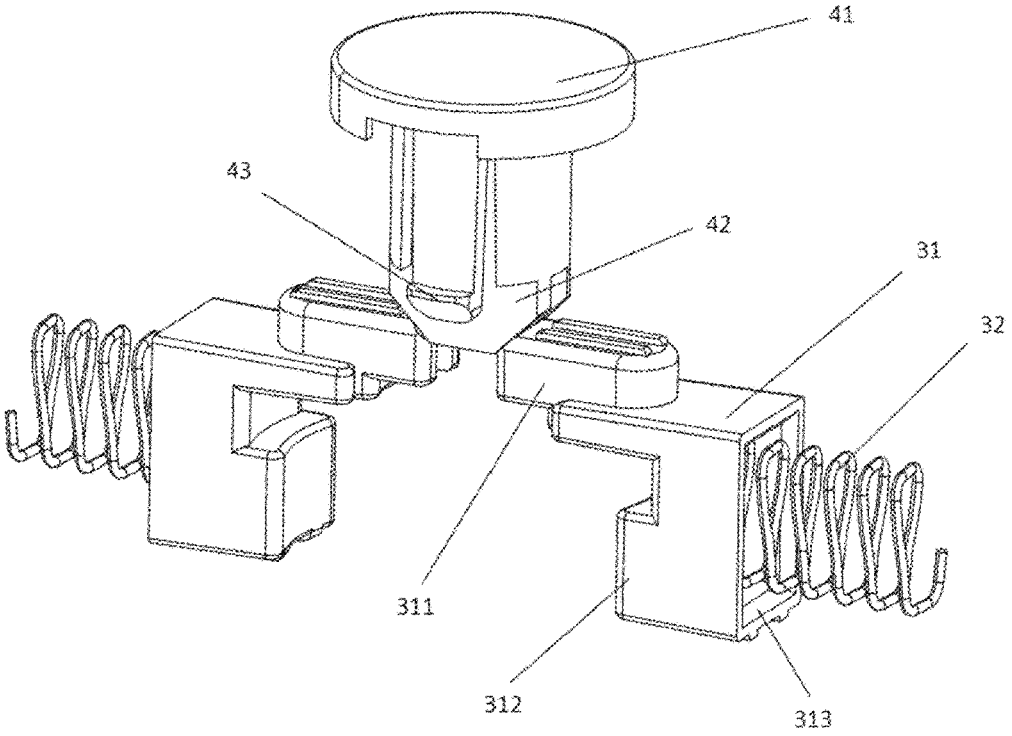
FIG. 10 is a schematic diagram illustrating engagement between the pressing module and the snapping module of the weight plate according to the embodiment of the present disclosure.

Optionally, as shown in FIGS. 3 and 6, in the embodiment, the second elastic member 44 is a spring. A first annular protrusion 13 is provided in the first channel 12, the second elastic member 44 is provided between the first annular protrusion 13 and the press button 41, for limiting the position of the second elastic member 44, a second annular protrusion 14 is further provided on the first annular protrusion 13 and one end of the second elastic member 44 close to the first annular protrusion 13 is sleeved on the second annular protrusion 14, so that the second elastic member 44 can be movably connected to the front fixing member 1.

Optionally, as shown in FIG. 1, in the embodiment, two second limiting protrusions 15 are further provided on the front fixing member 1, and a third limiting slot 22 coupled with the second limiting protrusions 15 is provided on the rear fixing member 2, to snap with the second limiting protrusions 15 of the adjacent weight plates, to prevent the adjacent weight plates from rotating after snapped.

Optionally, as shown in FIG. 1, in the embodiment, the barbell further comprises a weight assembly 6. The weight assembly 6 is connected to the front fixing member 1 and/or the rear fixing member 2, the weight of the weight assembly 6 is adjustable, and the weight of the single weight plate can be controlled by adjusting the quality of the weight assembly 6.

Optionally, as shown in FIG. 3, in the embodiment, the barbell further comprises a protective cover 7. The protective cover 7 is sleeved on the weight assembly 6 for protecting the weight assembly 6.

Optionally, as shown in FIG. 3, in the embodiment, the front fixing member 1 and/or the rear fixing member 2 are provided with a fourth limiting slot 16, and the snapping module 3 is provided in the fourth limiting slot 16.

Figure 11:
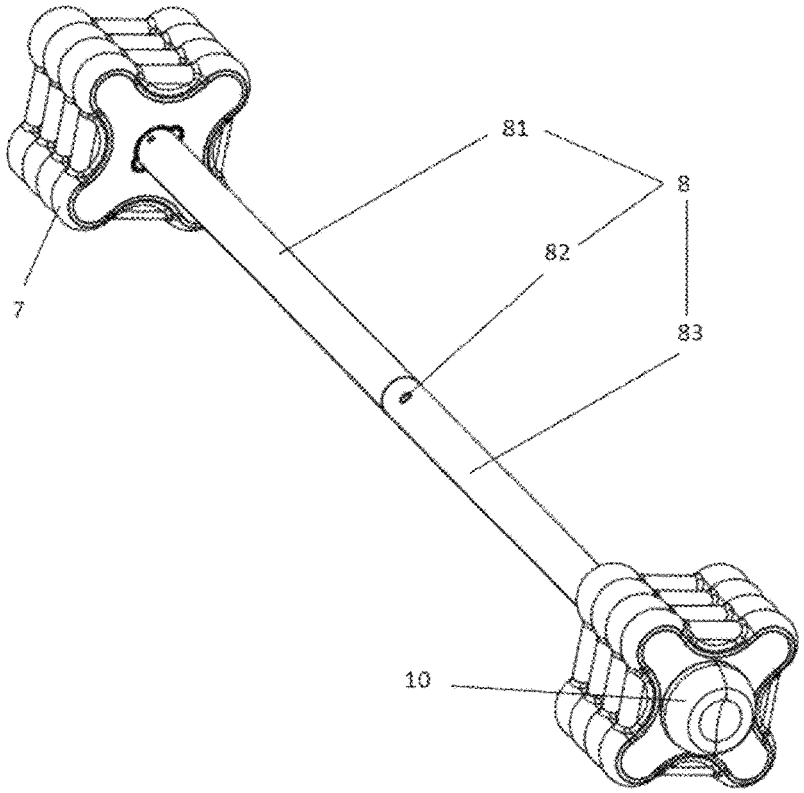
FIG. 11 is a schematic perspective view of the barbell according to the embodiment of the present disclosure.
Figure 12:
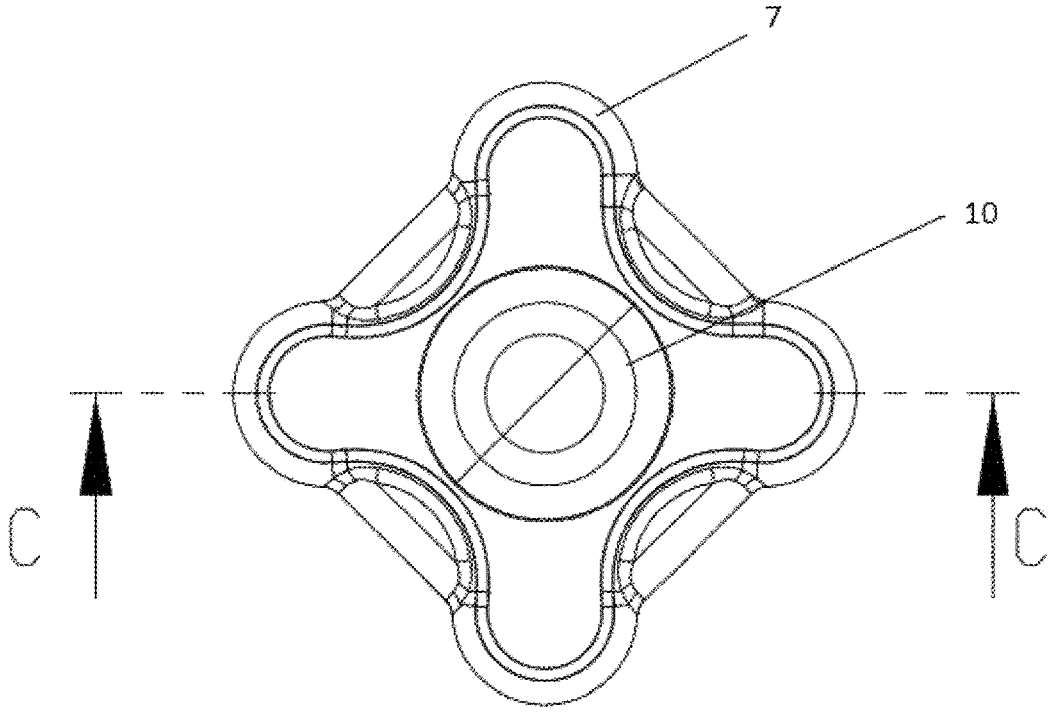
FIG. 12 is a left view of the barbell according to the embodiment of the present disclosure.
Figure 13:
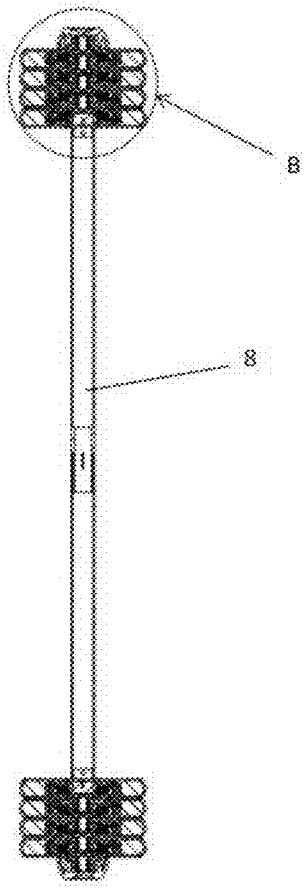
FIG. 13 is a cross-sectional view taken along C-C of FIG. 12.

Optionally, as shown in FIGS. 11 to 13, in the present embodiment, a protective shell 10 is also sleeved on the third snapping portion 11 of the outermost weight plate, to prevent the button 41 of the weight plate from being accidentally touched.

Optionally, as shown in FIGS. 11 and 13 to 17, the lever assembly 8 comprises:

a first rod body 81, where one end of the first rod body 81 is fixedly connected to the second snapping portion 912 of the corresponding first snapping portion 91 and the first rod body 81 is provided with a positioning hole;

an elastic pin 82, disposed at the other end of the first rod body 81 and protruded from the positioning hole on the first rod body 81; and a second rod body 83, where one end of the second rod body 83 is sleeved at the other end of the first rod body 81, the second rod body 83 is provided with a positioning hole and is fixed by the elastic pin 82 inserted into the positioning hole, and the other end of the second rod body 83 is fixedly connected to the second snapping portion 912 of the corresponding first snapping member 91. With the arrangement of the elastic pin 82 and the positioning hole, the position of the first rod body 81 and the second rod body 83 can be fixed while connected, so that the first limiting members 92 at two ends are located on the same horizontal plane, and then the position of the weight plates when snapped with the first snapping member 91 is fixed, so that the position of the weight plates at two ends is determined and the phenomenon of uneven height at two ends of the barbell is prevented. In addition, combining the first rod body 81 and the second rod body 83 into the lever assembly 8 reduces the overall length of the lever assembly 8 and facilitates disassembly and storage.

Optionally, as shown in FIG. 13, the first rod body 81 and the second rod body 83 are hollow rod bodies.

Figure 14:
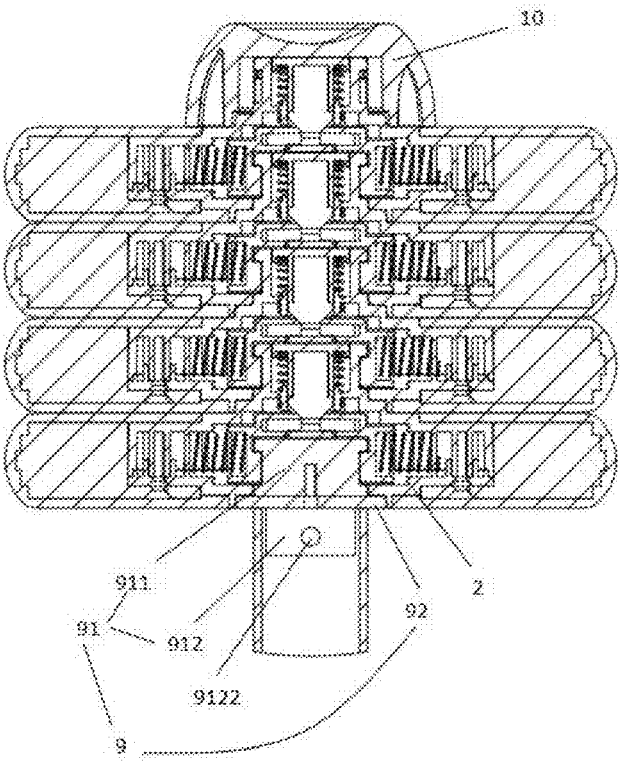
FIG. 14 is an enlarged view at B of FIG. 13.
Figure 15:
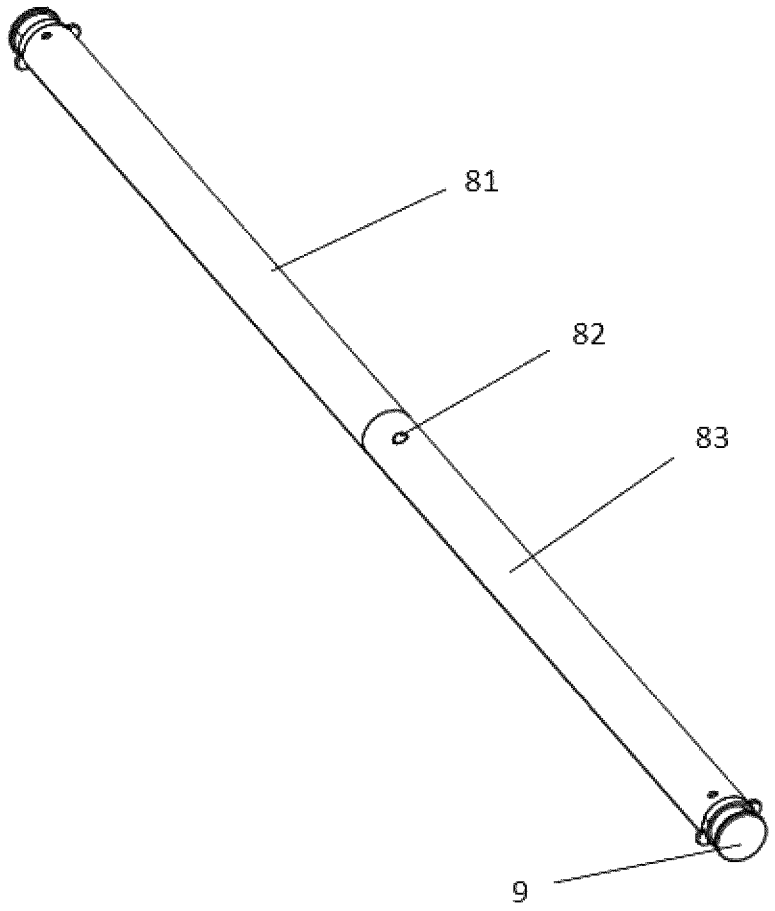
FIG. 15 is a schematic diagram of the lever assembly according to the embodiment of the present disclosure.
Figure 16:
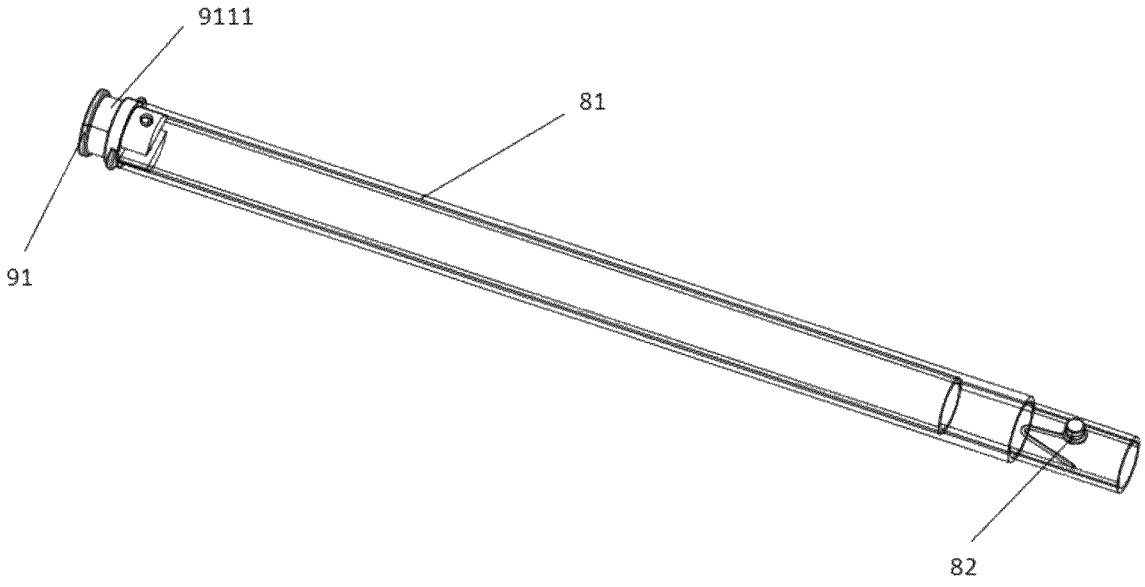
FIG. 16 is a schematic view of a partial sectional view of the lever assembly according to the embodiment of the present disclosure.
Figure 17:
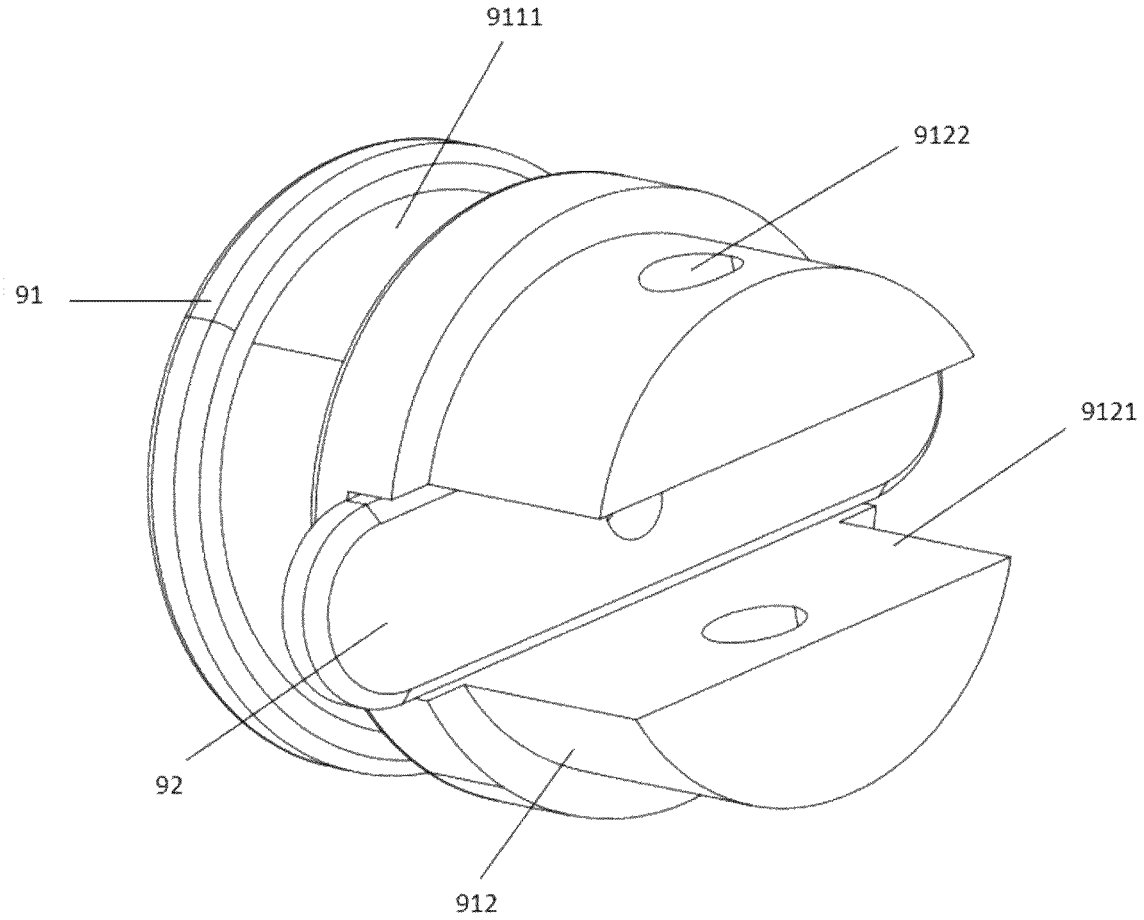
FIG. 17 is a schematic perspective view of the snapping assembly according to the embodiment of the present disclosure.

Optionally, as shown in FIGS. 14 and 17, the second snapping portion 912 is provided with a third snapping recess 9121, and the first limiting member 92 is provided in the third snapping recess 9121. Two sides of the third snapping recess 9121 are provided with a first positioning hole 9122, the first rod body 81 and the second rod body 83 are provided with positioning holes corresponding to the first positioning holes 9122, and the second snapping portion 912 is fixedly connected to the first rod body 81 and the second rod body 83 by screws. A second positioning hole (not shown in the drawings) is provided at the bottom of the third snapping recess 9121, a positioning hole corresponding to the second positioning hole is provided on the first limiting member 92, and the first limiting member 92 and the second snapping portion 912 are fixedly connected by screws.

First, the snapping principle between the two weight plates: when the two weight plates are snapped (assuming that one weight plate is a and the other weight plate is b), firstly, the third snapping portion 11 of the weight plate a is inserted into the second channel 21 of the rear fixing part 2 of the weight plate b, and the button 41 of the weight plate b is pushed inward at the same time, the button 41 drives the pressing member 42 to move inward, the second elastic member 44 is compressed, the pressing member 42 squeezes the first driving portions 311, so that the second snapping members 31 moves to two sides (while the first elastic member 32 is compressed), the third snapping portion 11 of the weight plate a is completely inserted into the second channel 21 of the rear fixing member 2 of the weight plate b, the second limiting protrusion 15 on the front fixing member 1 of the weight plate a enters the third limiting slot 22 on the rear fixing member 2 of the weight plate b, release the button 41 of the weight plate b, and the button 41 move back under the action of the second elastic member 44, and at the same time, under the action of the first elastic member 32, the second snapping members 31 are reset, the fourth snapping portion 312 is snapped into the second snapping recess 111 of the third snapping portion 11 of the weight plate b, the first limiting protrusion 314 of the weight plate b is inserted into the first sliding slot 51, and at this time, the two weight plates are snapped.

Second, the snapping principle between the snapping assembly 9 and the weight plate: First, the first snapping portion 911 of the snapping assembly 9 is inserted into the second channel 21 of the weight plate rear fixing member 2, and the button 41 of the weight plate is pushed inward at the same time, the button 41 drives the pressing member 42 to move inward, the second elastic member 44 is compressed, and the pressing member 42 squeezes the first driving portions 311, so that the second snapping members 31 moves to two sides (while the first elastic member 32 is compressed), and the first snapping portion 911 of the lever assembly 8 is completely inserted into the second channel 21 of the rear fixing member 2 of the weight plate, release the button 41 of the weight plate, and the button 41 is moved back under the action of the second elastic member 44. At the same time, the second snapping members 31 are reset under the action of the first elastic member 32, the fourth snapping portion 312 is snapped into the first snapping recess 9111 of the snapping assembly 9, and the first limiting protrusion 314 of the weight plate is inserted into the corresponding first sliding slot 51, and at this time, the weight plate is snapped with the snapping assembly 9.

During using, the first rod body 81, the second rod body 83, and the pair of snapping assemblies 9 are firstly mounted, and then the weight plate is snapped to the first snapping portion 911 of the corresponding first snapping member 91, and the other weight plates are gradually snapped from the outside of the weight plate according to the requirement.

As mentioned above, as shown in FIGS. 1 to 17, the barbell according to the embodiment of the disclosure has a simple structure, low cost, and easy storage. A plurality of weight plates can be snapped to each other, which has strong adaptability and replaceability. The weight for the bodybuilder can be adjusted by adjusting the number of the snapped weight plates. At the same time, the weight of one single weight plate can be controlled by adjusting the quality of the weight assembly.

It should be noted that in this specification, the terms "comprises", "comprising", or any other variation thereof are intended to encompass a non-exclusive inclusion such that a process, method, article, or apparatus that comprises a series of elements comprises not only those elements, but also other elements that are not explicitly listed, or elements inherent to such a process, method, article, or apparatus. Without further limitation, an element defined by the statement "comprises" does not preclude the presence of additional identical elements in a process, method, article, or apparatus that comprises the element.

Although the content of the present disclosure has been described in detail with reference to the above embodiment, it should be recognized that the foregoing description should not be construed as limiting the disclosure. Numerous modifications and alternatives to the present disclosure will be apparent to those skilled in the art upon reading the foregoing. Accordingly, the scope of protection of the present disclosure should be defined by the appended claims.

What is claimed is:

1. A barbell, comprising:

a lever assembly;

a pair of snapping assemblies, disposed at two ends of the lever assembly and fixedly connected to the lever assembly, wherein each of the snapping assemblies comprises a first snapping member and a first limiting member, one end of the first snapping member is provided with a first snapping portion, the other end of the first snapping member is provided with a second snapping portion, the first snapping portion is provided with a first snapping recess, and the first snapping member is fixedly connected to the first limiting member and is fixedly connected to the lever assembly through the second snapping portion; and a plurality of weight plates, snapped with each other and snapped with the first snapping portion;

wherein the weight plate comprises:

a front fixing member, provided with a third snapping portion and a first channel, wherein the first channel penetrates the third snapping portion and the third snapping portion is provided with a second snapping recess;

a rear fixing member, fixedly connected to the front fixing member and provided with a second channel;

a snapping module, movably disposed between the front fixing member and the rear fixing member, wherein the third snapping portion of an adjacent weight plate is capable of being inserted into the second channel to be snapped with the snapping module;

a pressing module, movably connected to the front fixing member through the first channel, to drive the snapping module to open and close; and a first limiting sleeve, sleeved on the pressing module and fixedly connected to the front fixing member, for limiting a maximum stroke of the pressing module, wherein a pair of first sliding slots and a pair of second sliding slots are disposed on two opposite sides of the first limiting sleeve;

wherein the lever assembly comprises:

a first rod body, wherein one end of the first rod body is fixedly connected to the second snapping portion of the corresponding first snapping member;

an elastic pin, disposed at the other end of the first rod body and protruded from the first rod body; and a second rod body, wherein one end of the second rod body is sleeved at the other end of the first rod body and fixed by an elastic pin, and the other end of the second rod body is fixedly connected to the second snapping portion of the corresponding first snapping member.

2. The barbell according to claim 1, wherein the snapping module comprises:

a pair of second snapping members, wherein an upper end of each of the second snapping members is provided with a first driving portion and a lower end of each of the second snapping members is provided with a fourth snapping portion, the first driving portion is connected to the pressing module, and the fourth snapping portion is connected to the second snapping recess of the adjacent weight plate; and a pair of first elastic members, wherein the pair of first elastic members are one-to-one corresponding to the pair of second snapping members, and are disposed between the corresponding second snapping members and the front fixing member or the rear fixing member, for resetting the corresponding second snapping member.

3. The barbell according to claim 2, wherein the second snapping member is provided with a first limiting slot and one end of the corresponding first elastic member is provided in the first limiting slot.

4. The barbell according to claim 3, wherein the pressing module comprises:

a button capable of being reciprocated and sliding inside the first channel;

at least one pressing member, wherein one end of the pressing member is fixedly connected to the button, and the other end of the pressing member is tapered and connected to the snapping module;

a pair of third snapping members, wherein the pair of third snapping members are respectively disposed on two sides of the pressing member, one end of each of the third snapping members is fixedly connected to the button, and the other end of each of the third snapping members is snapped with the front fixing member to prevent the pressing member from detaching from the first channel; and a second elastic member, wherein one end of the second elastic member is connected to the button and the other end of the second elastic member is connected to the front fixing member, for resetting the button.

5. The barbell according to claim 4, wherein the second elastic member is a spring, the first channel is provided with a first annular protrusion, the second elastic member is disposed between the first annular protrusion and the button, the first annular protrusion is further provided with a second annular protrusion, and one end of the second elastic member close to the first annular protrusion is sleeved on the second annular protrusion.

6. The barbell according to claim 3, wherein the front fixing member is further provided with at least one second limiting protrusion, and the rear fixing member is provided with a third limiting slot coupled with the second limiting protrusion.

7. The barbell according to claim 3, wherein the second snapping portion is provided with a third snapping recess, and the first limiting member is provided in the third snapping recess, two sides of the third snapping recess are respectively provided with a first positioning hole, and a bottom of the third snapping recess is provided with a second positioning hole.

8. The barbell according to claim 2, wherein the second snapping member is provided with a first limiting protrusion and a pair of second limiting slots;

wherein the first limiting protrusion is disposed on a lower side of the second snapping member and the pair of second limiting slots are disposed at two ends of the first limiting protrusion.

9. The barbell according to claim 8, wherein the pressing module comprises:

a button capable of being reciprocated and sliding inside the first channel;

at least one pressing member, wherein one end of the pressing member is fixedly connected to the button, and the other end of the pressing member is tapered and connected to the snapping module;

a pair of third snapping members, wherein the pair of third snapping members are respectively disposed on two sides of the pressing member, one end of each of the third snapping members is fixedly connected to the button, and the other end of each of the third snapping members is snapped with the front fixing member to prevent the pressing member from detaching from the first channel; and a second elastic member, wherein one end of the second elastic member is connected to the button and the other end of the second elastic member is connected to the front fixing member, for resetting the button.

10. The barbell according to claim 9, wherein the second elastic member is a spring, the first channel is provided with a first annular protrusion, the second elastic member is disposed between the first annular protrusion and the button, the first annular protrusion is further provided with a second annular protrusion, and one end of the second elastic member close to the first annular protrusion is sleeved on the second annular protrusion.

11. The barbell according to claim 8, wherein the front fixing member is further provided with at least one second limiting protrusion, and the rear fixing member is provided with a third limiting slot coupled with the second limiting protrusion.

12. The barbell according to claim 8, wherein the second snapping portion is provided with a third snapping recess, and the first limiting member is provided in the third snapping recess, two sides of the third snapping recess are respectively provided with a first positioning hole, and a bottom of the third snapping recess is provided with a second positioning hole.

13. The barbell according to claim 2, wherein the pressing module comprises:

a button capable of being reciprocated and sliding inside the first channel;

at least one pressing member, wherein one end of the pressing member is fixedly connected to the button, and the other end of the pressing member is tapered and connected to the snapping module;

a pair of third snapping members, wherein the pair of third snapping members are respectively disposed on two sides of the pressing member, one end of each of the third snapping members is fixedly connected to the button, and the other end of each of the third snapping members is snapped with the front fixing member to prevent the pressing member from detaching from the first channel; and a second elastic member, wherein one end of the second elastic member is connected to the button and the other end of the second elastic member is connected to the front fixing member, for resetting the button.

14. The barbell according to claim 13, wherein the second elastic member is a spring, the first channel is provided with a first annular protrusion, the second elastic member is disposed between the first annular protrusion and the button, the first annular protrusion is further provided with a second annular protrusion, and one end of the second elastic member close to the first annular protrusion is sleeved on the second annular protrusion.

15. The barbell according to claim 2, wherein the front fixing member is further provided with at least one second limiting protrusion, and the rear fixing member is provided with a third limiting slot coupled with the second limiting protrusion.

16. The barbell according to claim 2, wherein the second snapping portion is provided with a third snapping recess, and the first limiting member is provided in the third snapping recess, two sides of the third snapping recess are respectively provided with a first positioning hole, and a bottom of the third snapping recess is provided with a second positioning hole.

17. The barbell according to claim 1, wherein the pressing module comprises:

a button capable of being reciprocated and sliding inside the first channel;

at least one pressing member, wherein one end of the pressing member is fixedly connected to the button, and the other end of the pressing member is tapered and connected to the snapping module;

a pair of third snapping members, wherein the pair of third snapping members are respectively disposed on two sides of the pressing member, one end of each of the third snapping members is fixedly connected to the button, and the other end of each of the third snapping members is snapped with the front fixing member to prevent the pressing member from detaching from the first channel; and a second elastic member, wherein one end of the second elastic member is connected to the button and the other end of the second elastic member is connected to the front fixing member, for resetting the button.

18. The barbell according to claim 17, wherein the second elastic member is a spring, the first channel is provided with a first annular protrusion, the second elastic member is disposed between the first annular protrusion and the button, the first annular protrusion is further provided with a second annular protrusion, and one end of the second elastic member close to the first annular protrusion is sleeved on the second annular protrusion.

19. The barbell according to claim 1, wherein the front fixing member is further provided with at least one second limiting protrusion, and the rear fixing member is provided with a third limiting slot coupled with the second limiting protrusion.

20. The barbell according to claim 1, wherein the second snapping portion is provided with a third snapping recess, and the first limiting member is provided in the third snapping recess, two sides of the third snapping recess are respectively provided with a first positioning hole, and a bottom of the third snapping recess is provided with a second positioning hole.

* * * * *